US011154748B2

(12) United States Patent
Liu et al.

(10) Patent No.: US 11,154,748 B2
(45) Date of Patent: Oct. 26, 2021

(54) ELLIPTICAL TRAINER

(71) Applicant: Dyaco International Inc., Taipei (TW)

(72) Inventors: Han-Lin Liu, Taipei (TW); Shih-Wei Liu, Taipei (TW)

(73) Assignee: Dyaco International Inc., Taipei (TW)

( * ) Notice: Subject to any disclaimer, the term of this patent is extended or adjusted under 35 U.S.C. 154(b) by 0 days.

(21) Appl. No.: 16/921,527

(22) Filed: Jul. 6, 2020

(65) Prior Publication Data

US 2021/0244999 A1 Aug. 12, 2021

(30) Foreign Application Priority Data

Feb. 11, 2020 (TW) ..... 109104282

(51) Int. Cl.
*A63B 22/06* (2006.01)
*A63B 21/005* (2006.01)
*A63B 22/00* (2006.01)

(52) U.S. Cl.
CPC ..... *A63B 22/0664* (2013.01); *A63B 21/0058* (2013.01); *A63B 22/001* (2013.01); *A63B 2022/0682* (2013.01); *A63B 2225/09* (2013.01)

(58) Field of Classification Search
CPC ..... A63B 22/0664; A63B 22/0015; A63B 22/0023; A63B 22/0046; A63B 22/001; A63B 2022/0617; A63B 2022/0623; A63B 2022/067–0688; A63B 2022/0682; A63B 21/4034; A63B 21/4047; A63B 21/0058; A63B 2208/12; A63B 2225/093; A63B 2225/09
See application file for complete search history.

(56) References Cited

U.S. PATENT DOCUMENTS

| | | | | |
|---|---|---|---|---|
| 7,530,926 | B2 * | 5/2009 | Rodgers, Jr. ..... | A63B 22/001 482/51 |
| 7,611,446 | B2 * | 11/2009 | Chuang ..... | A63B 22/0015 482/52 |
| 7,811,206 | B2 * | 10/2010 | Chuang ..... | A63B 22/0056 482/52 |
| 7,871,356 | B2 * | 1/2011 | Smith ..... | A63B 22/0015 482/52 |
| 10,022,586 | B1 * | 7/2018 | Lee ..... | A63B 22/0664 |
| 2008/0261778 | A1 * | 10/2008 | Chuang ..... | A63B 22/0664 482/52 |
| 2009/0048077 | A1 * | 2/2009 | Chuang ..... | A63B 22/0664 482/62 |

* cited by examiner

*Primary Examiner* — Megan Anderson
*Assistant Examiner* — Kathleen Vermillera
(74) *Attorney, Agent, or Firm* — Donald E. Stout; Stout, Uxa & Buyan, LLP

(57) ABSTRACT

An embodiment of the present invention provides an elliptical trainer including structures featuring a first amplitude, a second amplitude, and a third amplitude. By the driving of cranks and the combination of the three amplitudes, the elliptical trainer's pedals move along a closed ellipse path. In addition, the first amplitude is more than twice or three times of the third amplitude, resulting in a wide adjustment range of the stride of the pedal. Accordingly, the elliptical trainer is applicable to users of various heights.

11 Claims, 11 Drawing Sheets

ELLIPTICAL TRAINER

CROSS-REFERENCE TO RELATED APPLICATIONS

The entire contents of Taiwan Patent Application No. 109104282, filed on Feb. 11, 2020, from which this application claims priority, are expressly incorporated herein by reference.

BACKGROUND OF THE INVENTION

1. Field of the Invention

The present invention relates to an elliptical trainer capable of adjusting a stride of pedals.

2. Description of Related Art

Most of conventional elliptical trainers cannot adjust the stride of the pedals according to the height of the user. For example, Taiwan patent Publication No. M403355 disclose an elliptical exercise machine featuring a lifting device that can alter the trajectory of the pedals. However, the stride of the pedals, i.e., the distance traversed in a step, is still fixed.

U.S. patent application Ser. No. 14/247,564 discloses an exercise device providing adjustable step distance. This exercise device has a disadvantage that wheels are employed in a slide mechanism, which will generate noise during operation, and the wheels will be worn after long-term use, leading to a poor durability.

Taiwan patent Publication No. 1332412 discloses an elliptical trainer. As shown in FIG. 1, a pair of cranks 30 is pivoted to a pivot 21, and respective two shafts 31 are disposed at distal ends of the two cranks 30 away from the pivot 21. Middle portions 41 of a pair of handles 40 are pivoted to a pivot 12, and each handle 40 has a stem 42 for holding by the user. Middle portions 51 of the pair of foot rods 50 are connected to the shaft 31 by a link 52, a front 53 of each foot rod 50 is connected to the bottom 44 of the corresponded handle 40, and a rear of each foot rod 50 includes a pedal 54 provided for the user to step on.

As shown in FIG. 1, the elliptical trainer also includes a linkage 32 to connect the handle 40 and the link 52. One end 33 of the linkage 32 is connected to the shaft 31, and the other end 34 of the linkage 32 is connected to a middle portion 41 of the handle 40 by a pivot 35. The middle portion 41 of the handle 40 is provided with a plurality of holes 43 for the pivot 35 to insert.

In the elliptical trainer shown in FIG. 1, because the cranks 30 move along a closed circular trajectory, the elevation of the pivot 12 must be higher than the elevation of the shaft 31. In addition, the middle portion 41 must be tilted backward by an angle; otherwise the operation will not be smooth or even impossible to operate. In addition, FIG. 2 shows the trajectory of the pedal of the elliptical trainer in FIG. 1 and the trajectory is simulated by computer software. As shown in FIG. 2, the trajectory of the pedal is not elliptical, but a closed quarter-moon shaped. Users will feel the transition is not smooth when operating the trainer. In addition, although the stride can be adjusted, its adjustment range is narrow and cannot be applied to users of various heights.

SUMMARY OF THE INVENTION

In one general aspect, the present invention relates to an elliptical trainer with a stride that can be adjusted in a wide range.

In one embodiment, an elliptical trainer is provided with a supporting frame, a resistance device, a resistance device, two cranks, and two operating units. The resistance device comprises a shaft. A first end of each of the two cranks is connected to the shaft. The two operating units are respectively arranged on a left side and a right side of the shaft and respectively connect to one crank. Each operating unit comprises a first pivot, a second pivot, a third pivot, a front swing rod, a rear swing rod, a middle swing rod, a push rod, an amplitude-linking mechanism, a pedal-supporting rod, and a pedal. The first pivot is arranged on the supporting frame. The second pivot is arranged at the second end of the crank. The third pivot is arranged on the supporting frame. A first end of the front swing rod is pivotally connected to the first pivot. A first end of the rear swing rod is pivotally connected to the second pivot. A first end of the middle swing rod is pivotally connected to the third pivot. A first end of the push rod is pivotally connected to the second pivot, and a second end of the push rod is pivotally connected to a second end of the middle swing rod. A first end of the amplitude-linking mechanism is connected to the middle swing rod, and a second end of the amplitude-linking mechanism is connected to the front swing rod. A first end of the pedal-supporting rod is pivotally connected to the second end of the front swing rod, and a second end of the rear swing rod is pivotally connected to a middle portion of the pedal-supporting rod. The pedal is connected to a second end of the pedal-supporting rod.

DETAILED DESCRIPTION OF THE PREFERRED EMBODIMENT

Figure 1:
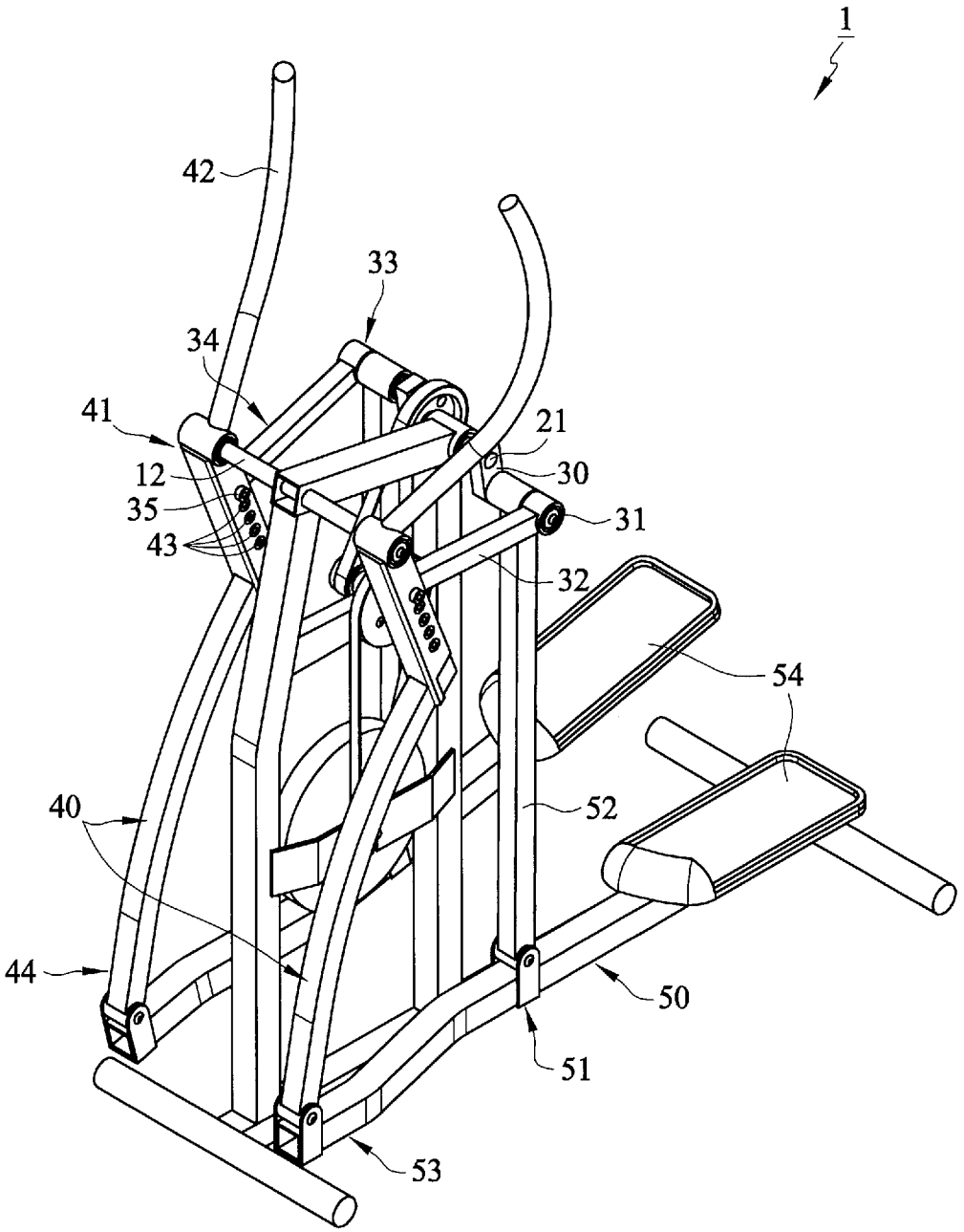
FIG. 1 (Prior Art)
FIG. 1 shows a conventional elliptical trainer.
Figure 2:
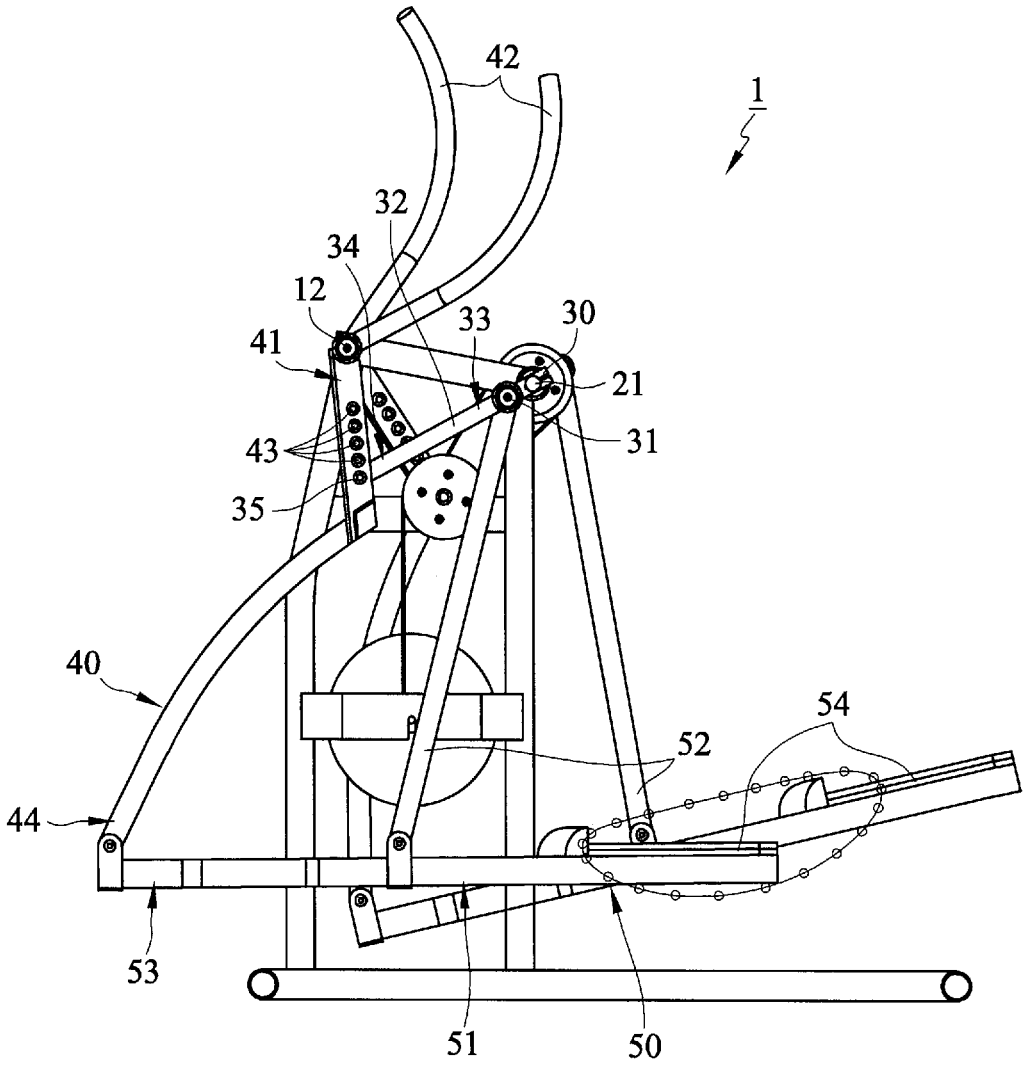
FIG. 2 (Prior Art)
FIG. 2 shows the moving path of the pedal in the elliptical trainer of FIG. 1.
Figure 3:
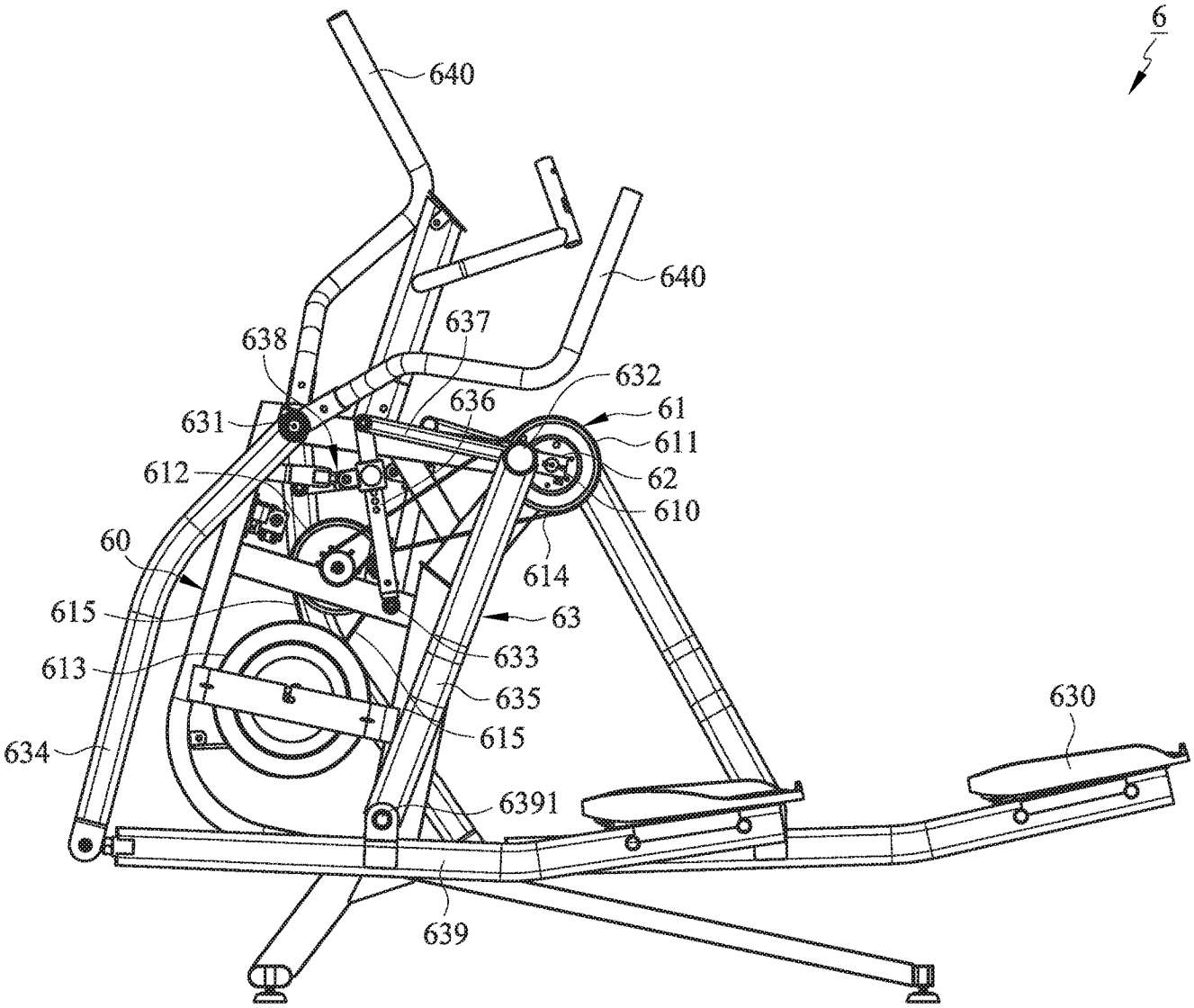
FIG. 3 is a side view of an elliptical trainer in accordance with an embodiment of the present invention.
Figure 4:
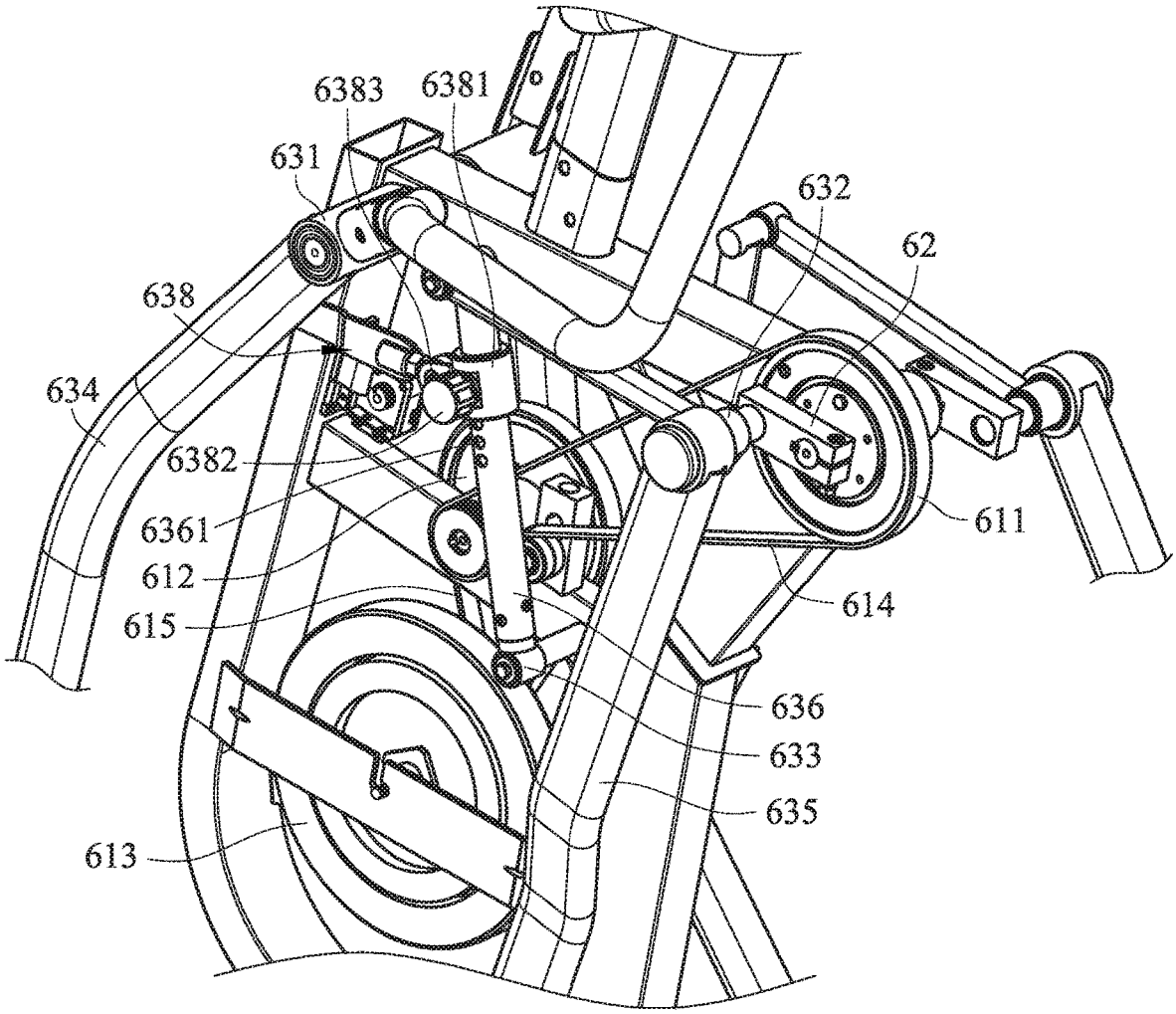
FIG. 4 is a partially enlarged view of the elliptical trainer of FIG. 3.

FIG. 3 is a side view of an elliptical trainer 6 in accordance with an embodiment of the present invention. FIG. 4 is a partially enlarged view of the elliptical trainer 6 shown in FIG. 3. Referring to FIGS. 3 and 4, the elliptical trainer 6 includes a supporting frame 60, a resistance device 61, two cranks 62, and two operation units 63. The resistance device 61 includes a shaft 610. The two cranks 62 are respectively arranged at the left and right side of the shaft 610, and a first end of each crank 62 is connected to the shaft 610. The two operation units 63 are respectively arranged at left and right side of the shaft 610 and each connects to one crank 62. Each operation unit 63 includes a pedal 630, a first pivot 631, a second pivot 632, a third pivot 633, a front swing rod 634, a rear swing rod 635, a middle swing rod 636, a push rod 637, an amplitude-linking mechanism 638, and a pedal-supporting rod 639. The first pivot 631 is mounted on the supporting frame 60. The second pivot 632 is provided at a second end of the crank 62. The third pivot 633 is mounted on the supporting frame 60. The first end of the front swing rod 634 is pivotally connected to the first pivot 631, the second end of the front swing rod 634 is pivotally connected to the first end of the pedal-supporting rod 639, and the second end of the pedal-supporting rod 639 is connected to the pedal 630. The first end of the rear swing rod 635 is pivotally connected to the second pivot 632, and the second end of the rear swing rod 635 is pivotally connected to a pivot 6391 in the middle portion of the pedal-supporting rod 639. The first end of the middle swing rod 636 is pivotally connected to the third pivot 633. The first end of the push rod 637 is pivotally connected to the second pivot 632, and the second end of the push rod 637 is pivotally connected to the second end of the middle swing rod 636. The first end of the amplitude-linking mechanism 638 is connected to the middle swing rod 636, and the second end of the amplitude-linking mechanism 638 is connected to the front swing rod 634. In addition, each operation unit 63 may further include a handle 640, one end of which is connected to the first pivot 631.

Referring to FIG. 3 and FIG. 4, in this embodiment, the resistance device 61 includes, but is not limited to, a first wheel 611, a second wheel 612, a flywheel 613, a first connection member 614, and a second connection member 615. The first wheel 611 includes the shaft. The first wheel 611 is connected to the second wheel 612 through the first connection member 614. The second wheel 612 is connected to the flywheel 613 through the second connection member 615, and the flywheel 613 provides a resistance. In another embodiment, the second wheel 612 and the second connection member 615 are omitted, and the first wheel 611 is connected to the flywheel 613 through the first connection member 614.

Figure 5:
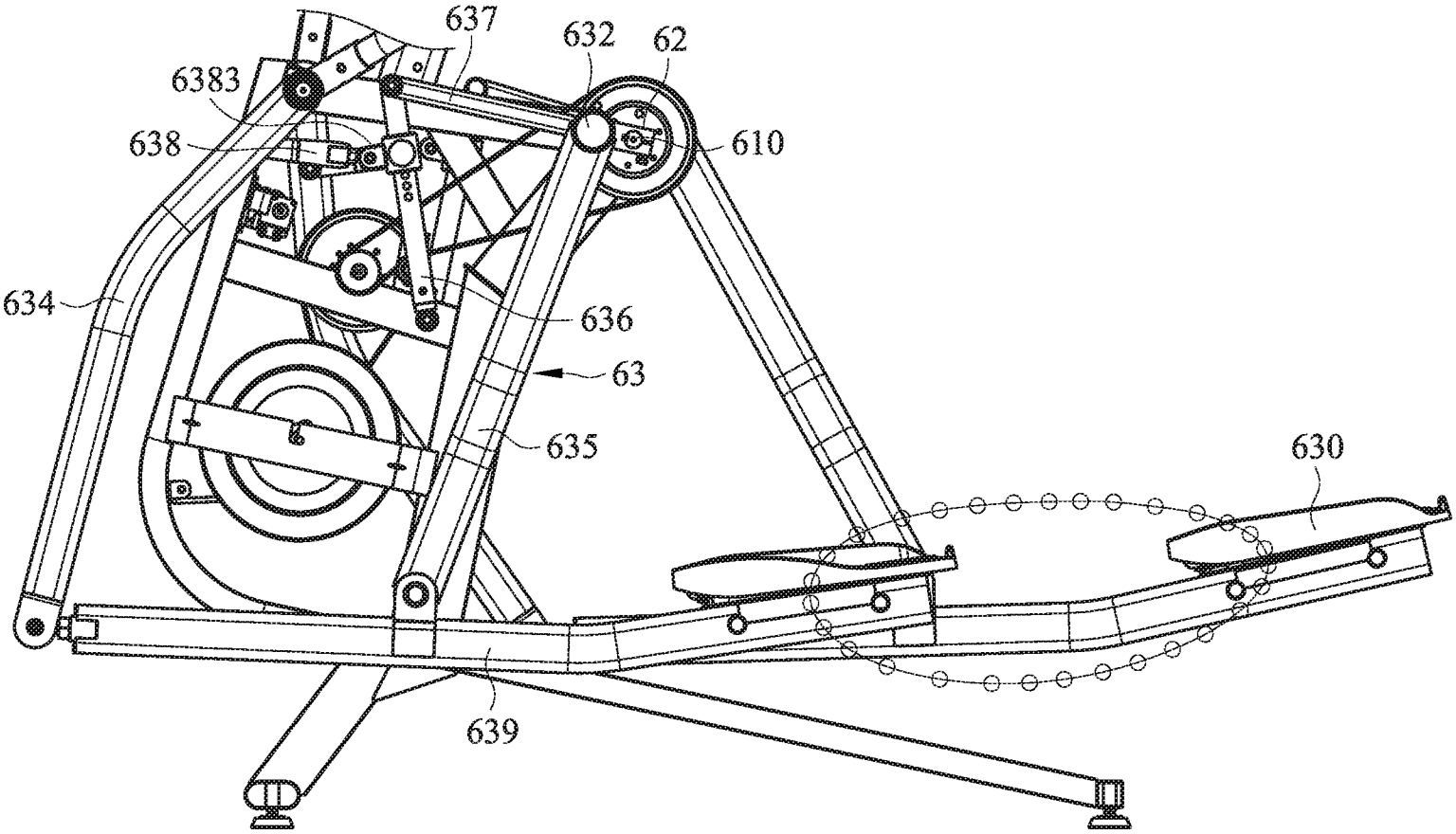
FIG. 5 is a partially side view of the elliptical trainer of FIG. 3 operating in a certain state.

FIG. 5 is a partially side view of the elliptical trainer 6 operating at a certain state. Referring to FIGS. 3 to 5, the front swing rod 634 performs a first amplitude around the first pivot 631, and the crank 62 drives the rear swing rod 635 to perform a second amplitude around the second pivot 632. The middle swing rod 636 performs a third amplitude around the third pivot 633. The trajectories of both the first amplitude and the third amplitude are arc-shaped. And the trajectory of the pedal 630 is the combination of the first amplitude, the second amplitude, and the third amplitude. Since the direction of the first amplitude is opposite to that of the third amplitude, a portion of the first amplitude is canceled, resulting in an elliptical moving path of the pedal 630.

Referring to FIGS. 3 to 5, the first end 6383 of the amplitude-linking mechanism 638 is movably connected to the middle swing rod 636, and the second end 6384 (FIG. 6A) of the amplitude-linking mechanism 638 is fixed to the inside of the front swing rod 634. By adjusting a vertical position of the first end 6383 of the amplitude-linking mechanism 638 mounted on the middle swing rod 636, the stride of the pedal 630 can be adjusted. Taking FIG. 4 as an example, the first end 6383 of the amplitude-linking mechanism 638 is pivotally connected to a collar 6381 sleeved on the middle swing rod 636. In addition, the middle swing rod 636 has a plurality of positioning holes 6361, and a positioning member 6382 passes through a perforation (not shown) of the collar 6381 and is fixed to one certain positioning hole 6361. The longer the distance between the positioning member 6382 and the third pivot 633, the greater the stride of the pedal 630. In some embodiments, the distance between the second end 6384 (FIG. 6A) of the amplitude-linking mechanism 638 and the first pivot 631 is less than the distance between the first end 6383 (or the positioning member 6382) of the amplitude-linking mechanism 638 and the third pivot 633. In some embodiments, the distance between the second end 6384 of the amplitude-linking mechanism 638 and the first pivot 631 is between 70 mm and 120 mm.

According to the elliptical trainer 6 provided by embodiments of the present invention, the combination of the three amplitudes makes the pedal 630 moving along a closed elliptical trajectory, and the stride of the pedal 630 can be adjusted in a wide range. The principle of the stride adjustment is described below with reference to FIGS. 6A to 7B.

Figure 6A:
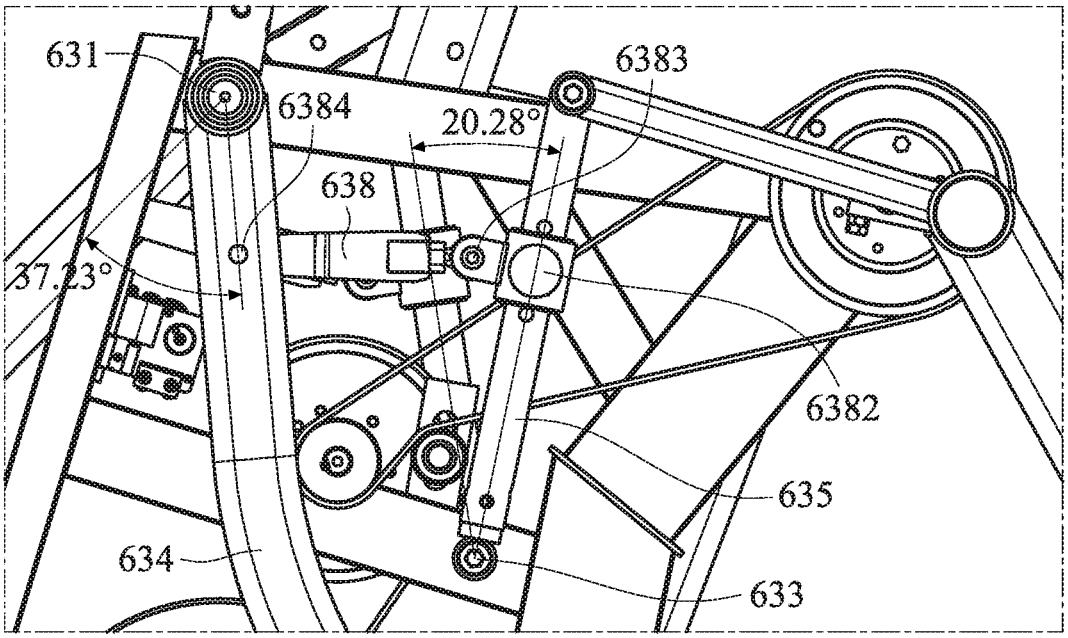
FIG. 6A is a partially side view of the elliptical trainer of FIG. 3 operating in a certain state.
Figure 6B:
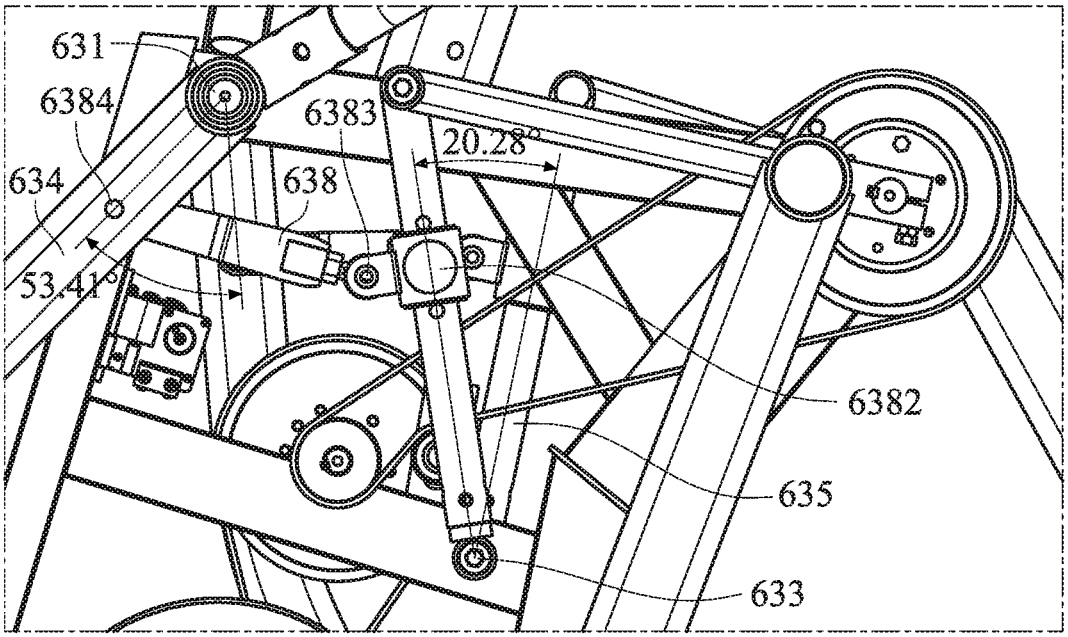
FIG. 6B is a partially side view of the elliptical trainer of FIG. 3 operating in a certain state.

FIGS. 6A and 6B are partially side views of the elliptical trainer 6 operating in a certain state. The difference between FIG. 6A and FIG. 6B is that the distance between the second end 6384 of the amplitude-linking mechanism 638 and the first pivot 631. As shown in FIG. 6A, the distance between the second end 6384 of the amplitude-linking mechanism 638 and the first pivot 631 is 114 mm. As shown in FIG. 6B, the distance between the second end 6384 of the amplitude-linking mechanism 638 and the first pivot 631 is 74 mm. In addition, the distance between the third pivot 633 and the positioning member 6382 is 212.50 mm in both FIGS. 6A and 6B. As shown in FIG. 6A, when the angle of the third amplitude is 20.28°, the angle of the first amplitude is 37.23°. As shown in FIG. 6B, when the angle of the third amplitude is 20.28°, the angle of the first amplitude is 53.41°. As can be seen from FIGS. 6A and 6B, when the distance between the second end 6384 of the amplitude-linking mechanism 638 and the first pivot 631 is shorter, the angle of the first amplitude of the front swing rod 634 is larger. In some embodiments, the distance between the second end 6384 of the amplitude-linking mechanism 638 and the first pivot 631 is less than or equal to 114 mm. In some embodiments, the distance between the second end 6384 of the amplitude-linking mechanism 638 and the first pivot 631 is less than or equal to 74 mm.

Figure 7A:
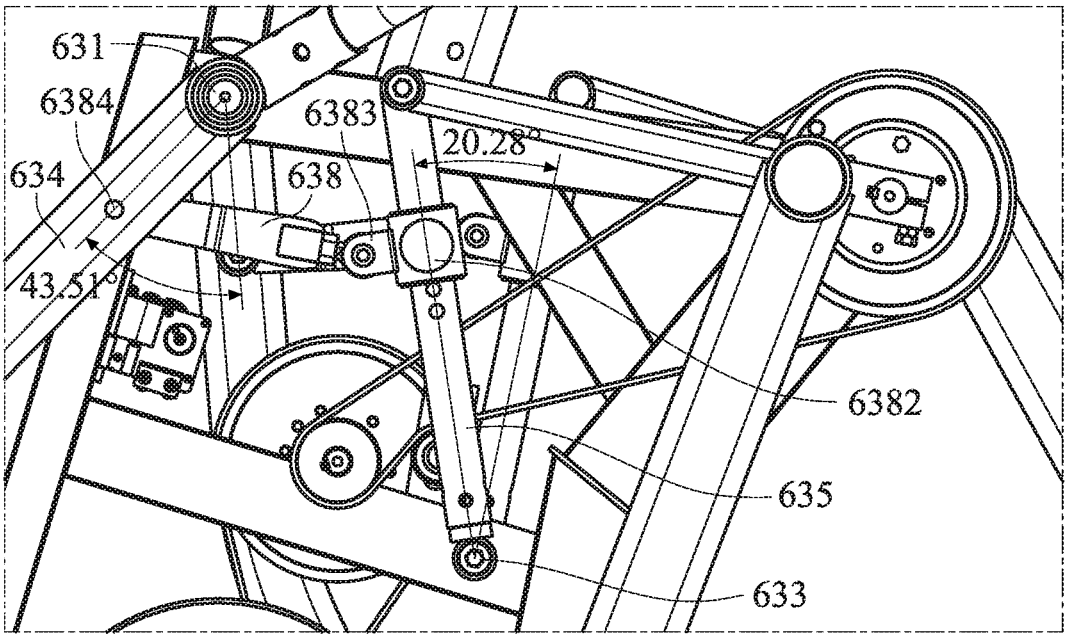
FIG. 7A is a partially side view of the elliptical trainer of FIG. 6A wherein the length of a third amplitude is increased.
Figure 7B:
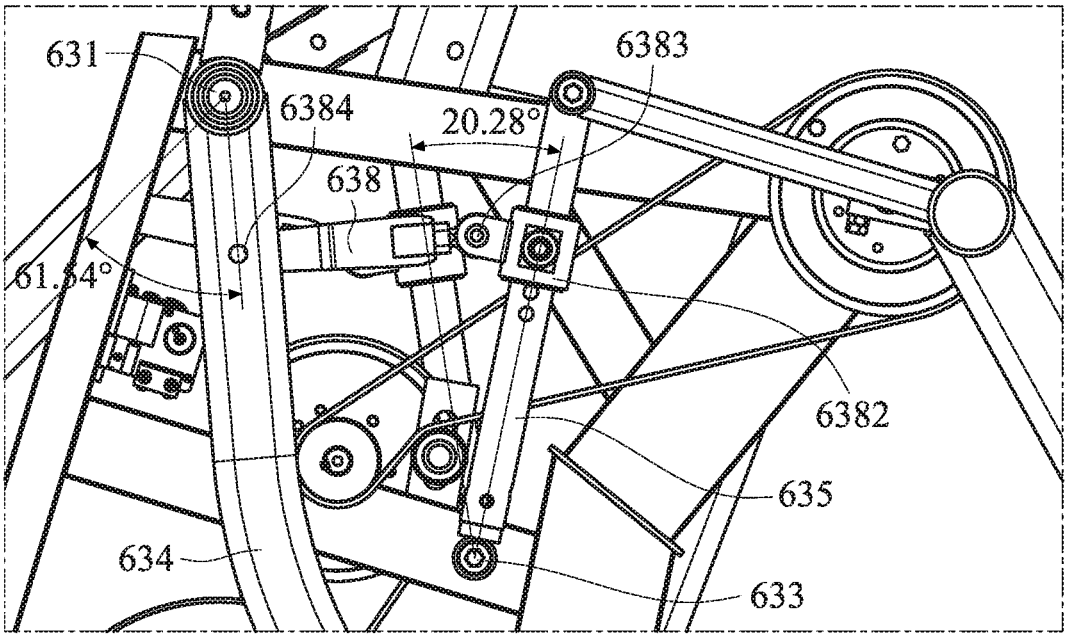
FIG. 7B is a partially side view of the elliptical trainer of FIG. 6B wherein the length of a third amplitude is increased.

FIGS. 7A and 7B are partially side views of the elliptical trainer 6 operating in a certain state. The difference between FIG. 7A and FIG. 7B is that the distance between the second end 6384 of the amplitude-linking mechanism 638 and the first pivot 631. In FIG. 7A, the distance between the second end 6384 of the amplitude-linking mechanism 638 and the first pivot 631 is 114 mm. In FIG. 7B, the distance between the second end 6384 of the amplitude-linking mechanism 638 and the first pivot 631 is 74 mm. In addition, FIG. 7A is different from FIG. 6A in that the distance between the third pivot 633 and the positioning member 6382 is increased from 212.50 mm to 228.50 mm. FIG. 7B is different from FIG. 6B in that the distance between the third pivot 633 and the positioning member 6382 is increased from 212.50 mm to 228.50 mm. As shown in FIG. 7A, when the angle of the third amplitude is 20.28°, the angle of the first amplitude is 43.5°. As shown in FIG. 7B, when the angle of the third amplitude is 20.28°, the angle of the first amplitude is 61.54°.

As can be seen from FIGS. 7A and 7B, when the vertical position of the positioning member 6382 is adjusted so that the distance from the third pivot 633 is increased by only 16 mm, the first amplitude can be more than twice or even three times of the third amplitude.

Figure 8:
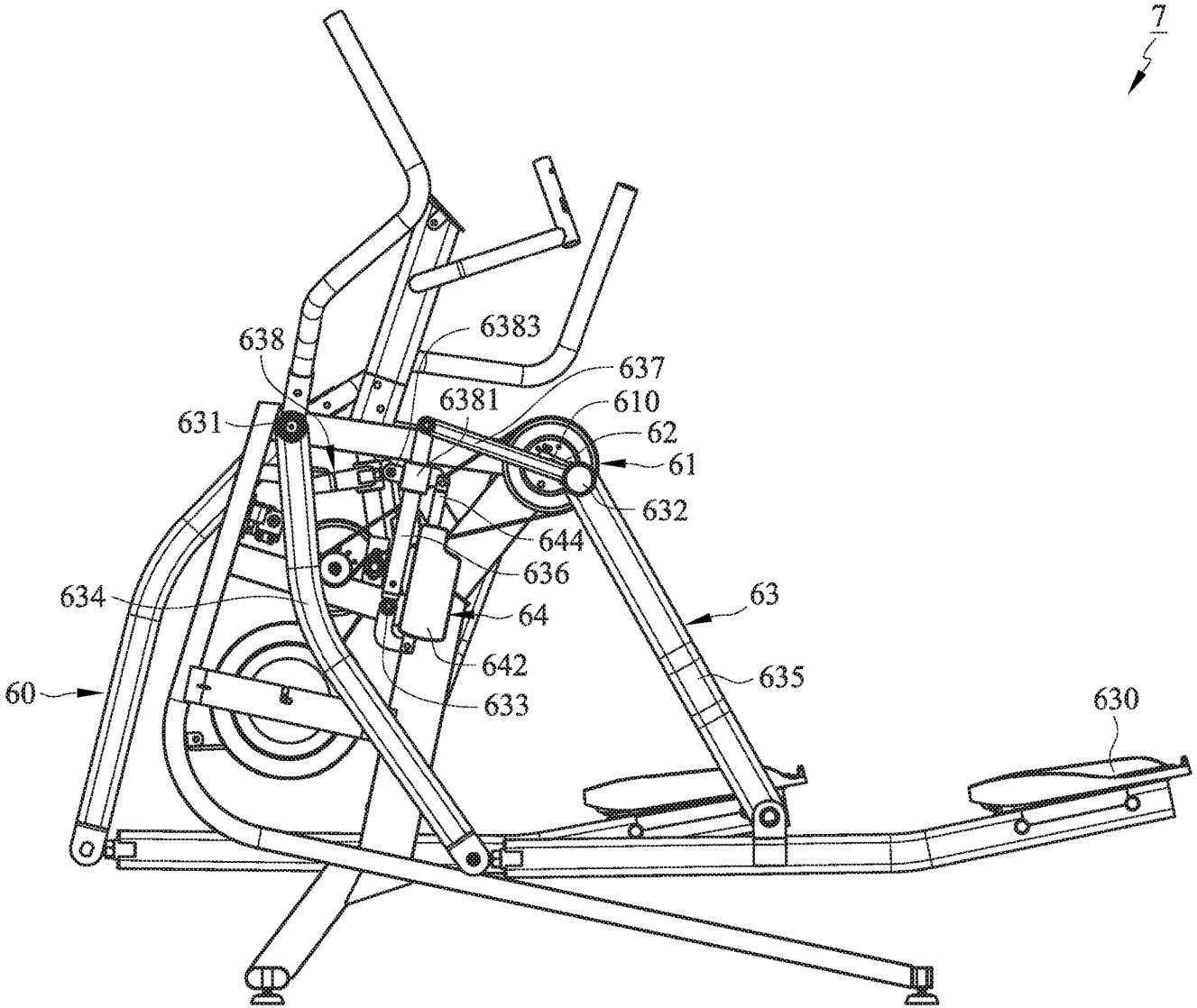
FIG. 8 is a side view of an elliptical trainer in accordance with another embodiment of the present invention.
Figure 9:
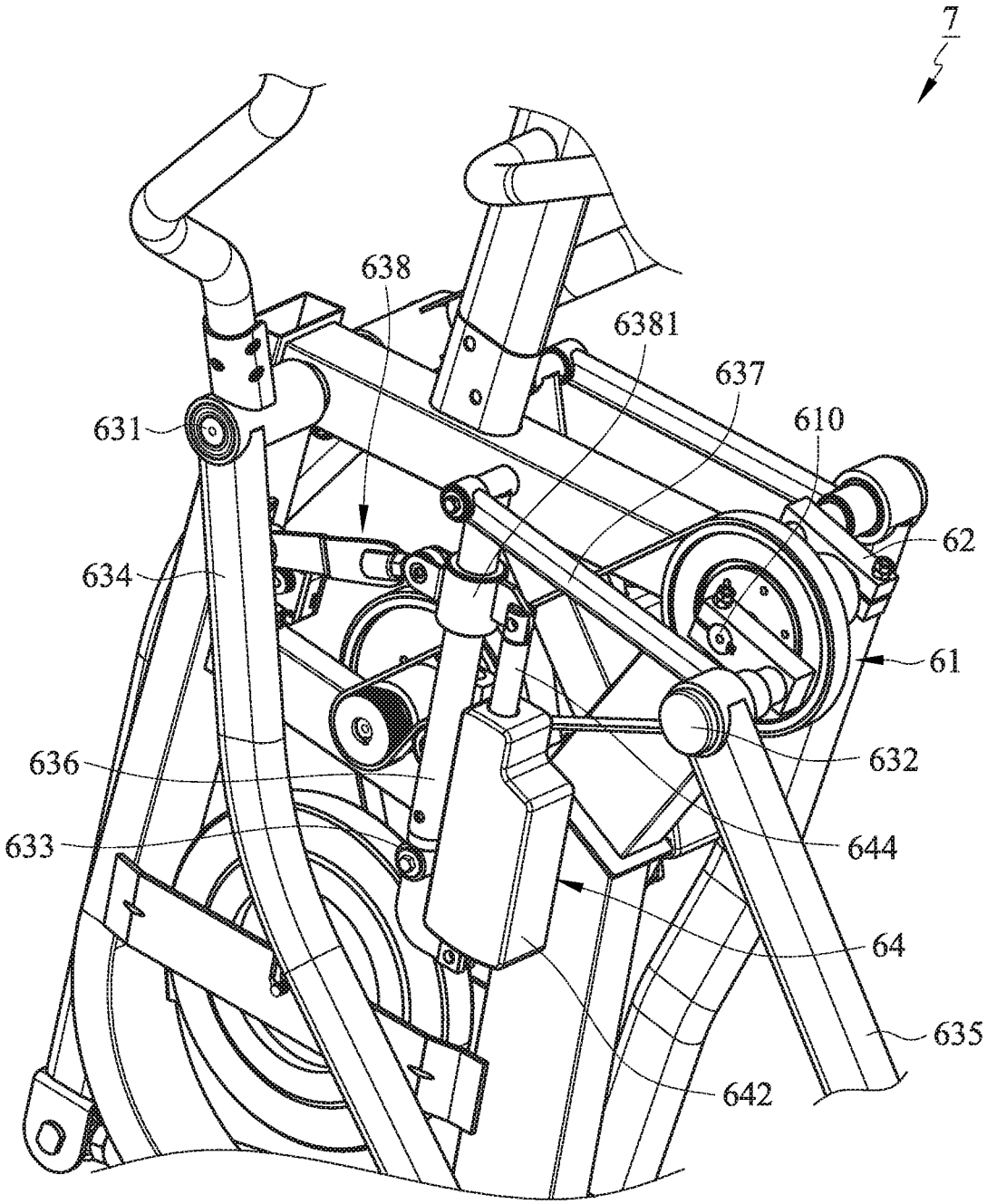
FIG. 9 is a partially enlarged view of the elliptical trainer of FIG. 8.

FIG. 8 is a side view of an elliptical trainer 7 in accordance with another embodiment of the present invention. FIG. 9 is a partially enlarged view of the elliptical trainer 7 shown in FIG. 8. The elliptical trainer 7 differs from the elliptical trainer 6 in that the elliptical trainer 7 includes two driving units 64 respectively disposed on the left and right sides of the shaft 610. Each driving unit 64 includes a motor 642 and a screw 644. One end of the screw 644 is connected to the collar 6381, and the motor 642 can drive the screw 644 to rotate so as to determine a vertical position of the collar 6381 in the middle swing rod 636.

Figure 10:
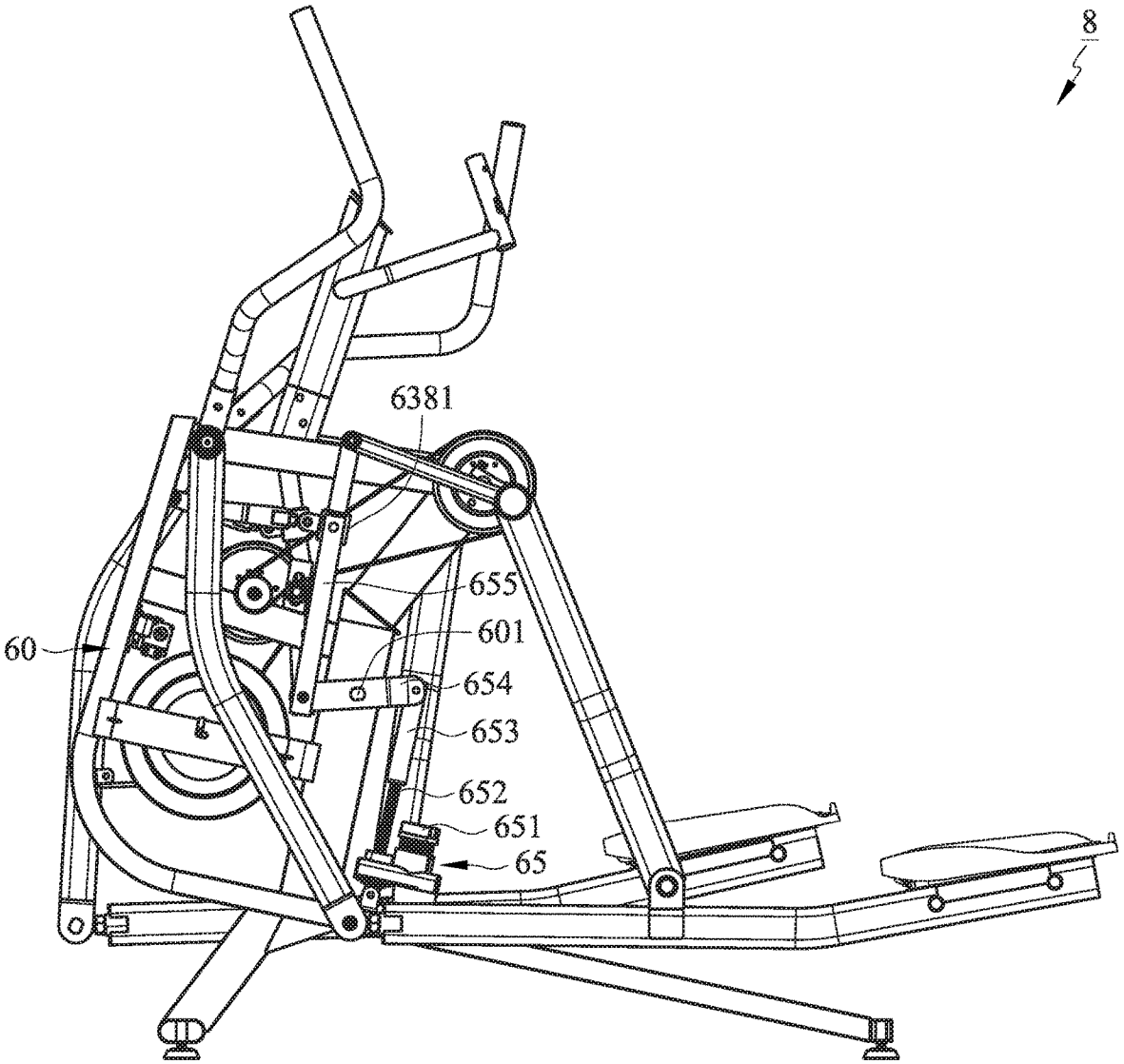
FIG. 10 is a side view of an elliptical trainer in accordance with another embodiment of the present invention.
Figure 11:
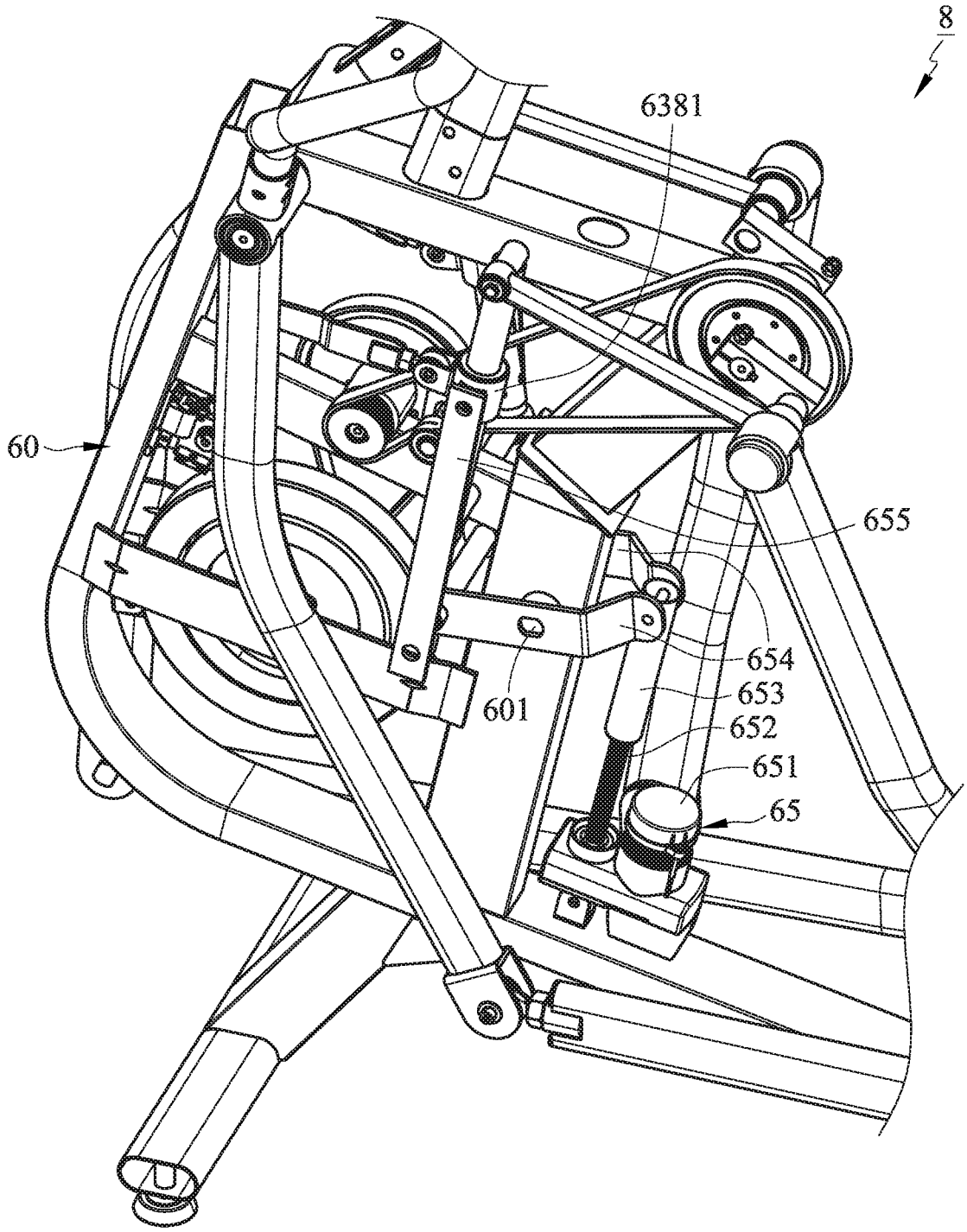
FIG. 11 is a partially enlarged view of the elliptical trainer of FIG. 10.

FIG. 10 is a side view of an elliptical trainer 8 in accordance with another embodiment of the present invention. FIG. 11 is a partially enlarged view of the elliptical trainer 8 shown in FIG. 10. The elliptical trainer 8 differs from the elliptical trainer 6 in that the elliptical trainer 8 includes a single drive unit 65. The driving unit 65 includes a motor 651, a screw 652, a sleeve 653, two first links 654, and two second links 655. The motor 651, the screw 652, and the sleeve 653 may be disposed around a central portion of the supporting frame 60. The motor 651 can drive the screw 652 to rotate; so that the sleeve 653 screwed with the screw 652 can move vertically along the screw 652. The two first links 654 and two second links 655 are located on the left and right sides of the supporting frame 60, respectively. The middle portion of each first link 654 is pivotally connected to a pivot 601 of the supporting frame 60, the first end of each first link 654 is pivotally connected to the sleeve 653, the second end of each first link 654 is pivotally connected to the first end of the second link 655, and the second end of the second link 655 is pivotally connected to the collar 6381. In this way, a vertical position of the collar 6381 on the middle swing rod 636 is determined by controlling the vertical movement of the sleeve 653 on the screw 652.

The elliptical trainers provided by embodiments of the present invention include the following features. First, the pedals move along an elliptical closed trajectory. The elliptical closed trajectory has no turning point, and the user feels smooth during the operation. The exercise time and effect can be extended and improved, and the willingness to consume such product will increase significantly.

Furthermore, in the elliptical trainers provided by embodiments of the present invention, the third amplitude is connected to the second amplitude, and the third amplitude is connected to the first amplitude. This arrangement makes the adjustment of the pedal stride has a multiplier effect, that is, the first amplitude is more than twice or three times of the third amplitude and this will result in a wide adjustment range of the pedal stride. Due to the wide adjustment range of the pedal stride, the provided elliptical trainers are suitable for users of various heights, including adults and children.

What is claimed is:

1. An elliptical trainer, comprising:

a supporting frame;

a resistance device comprising a shaft;

two cranks, a first end of each of the two cranks being connected to the shaft;

two operating units being respectively arranged on a left side and a right side of the shaft and respectively connecting to one of the two cranks, wherein each of the two operating units comprises:

a first pivot being arranged on the supporting frame;

a second pivot being arranged at a second end of the respective one of the two cranks;

a third pivot being arranged on the supporting frame;

a front swing rod, a first end of the front swing rod being pivotally connected to the first pivot;

a rear swing rod, a first end of the rear swing rod being pivotally connected to the second pivot;

a middle swing rod, a first end of the middle swing rod being pivotally connected to the third pivot;

a push rod, a first end of the push rod being pivotally connected to the second pivot, a second end of the push rod being pivotally connected to a second end of the middle swing rod;

an amplitude-linking mechanism, a first end of the amplitude-linking mechanism being connected to the middle swing rod, a second end of the amplitude-linking mechanism being connected to the front swing rod;

a pedal-supporting rod, a first end of the pedal-supporting rod being pivotally connected to the second end of the front swing rod, a second end of the rear swing rod being pivotally connected to a middle portion of the pedal-supporting rod; and a pedal being connected to a second end of the pedal-supporting rod.

2. The elliptical trainer as recited in claim 1, wherein for each of the two operating units, the first end of the amplitude-linking mechanism is movably connected to the middle swing rod, and the second end of the amplitude-linking mechanism is fixed to the front swing rod, so that a stride of the pedal is determined by adjusting a vertical position of the first end of the amplitude-linking mechanism mounted on the middle swing rod.

3. The elliptical trainer as recited in claim 2, wherein for each of the two operating units, the first end of the amplitude-linking mechanism is pivotally connected to a collar mounted on the middle swing rod.

4. The elliptical trainer as recited in claim 3, wherein for each of the two operating units, the middle swing rod further comprises a plurality of positioning holes, and the amplitude-linking mechanism further comprises a positioning member to pass through a perforation of the collar and to fix to one of the plurality of positioning holes.

5. The elliptical trainer as recited in claim 3, further comprising two drive units respectively located on a left side and a right side of the shaft, wherein each of the two drive units comprises a motor and a screw, one end of the screw is connected to the collar of the respective one of the two operating units, and the motor drives the screw to rotate to adjust the vertical position of the collar on the middle swing rod of the respective one of the two operating units.

6. The elliptical trainer as recited in claim 3, further comprising a driving unit, which comprises:

a motor;

a screw;

a sleeve;

two first links; and two second links;

wherein the motor, the screw, and the sleeve are disposed at a central portion of the supporting frame, the motor drives the screw to rotate, and the screw is screwed to the sleeve, and wherein the two first links and the two second links are respectively located at the left side and the right side of the supporting frame, a middle portion of each of the two first links is pivotally connected to a pivot of the supporting frame, a first end of each of the two first links is pivotally connected to the sleeve, a second end of each of the two first links is pivotally connected to a first end of the respective one of the two second links, and a second end of each of the two second links is pivotally connected to the collar of the respective one of the two operating units.

7. The elliptical trainer as recited in claim 2, wherein for each of the two operating units, a distance between the second end of the amplitude-linking mechanism and the first pivot is between 70 mm and 120 mm.

8. The elliptical trainer as recited in claim 2, wherein for each of the two operating units, a distance between the second end of the amplitude-linking mechanism and the first pivot is smaller than a distance between the first end of the amplitude-linking mechanism and the third pivot.

9. The elliptical trainer as recited in claim 1, wherein for each of the two operating units, the front swing rod performs a first amplitude around the first pivot, the respective one of the two cranks drives the rear swing rod to perform a second amplitude around the second pivot, and the middle swing rod performs a third amplitude around the third pivot, and wherein a direction of the first amplitude is opposite to a direction of the third amplitude, and the trajectory of the pedal is a combination of the first amplitude, the second amplitude, and the third amplitude.

10. The elliptical trainer as recited in claim 9, wherein the first amplitude is more than twice of the third amplitude.

11. The elliptical trainer as recited in claim 9, wherein the first amplitude is more than three times of the third amplitude.

* * * * *